United States Patent [19]

Scism

[11] Patent Number: 4,741,124

[45] **Date of Patent: * May 3, 1988**

[54] PLANT BASKET

[76] Inventor: Bruce T. Scism, Route 5, Box 166, Kings Mountain, N.C. 28086

[ * ] Notice: The portion of the term of this patent subsequent to Mar. 3, 2004 has been disclaimed.

[21] Appl. No.: 9,356

[22] Filed: Jan. 30, 1987

Related U.S. Application Data

[63] Continuation of Ser. No. 707,241, Mar. 1, 1985, Pat. No. 4,646,469.

[51] Int. Cl.[4] ..... A01G 9/02

[52] U.S. Cl. ..... 47/67; 47/72

[58] Field of Search ..... 47/66, 67, 71, 73, 72, 47/84; 217/122, 123, 125; 220/1 C

[56] References Cited

U.S. PATENT DOCUMENTS

| | | |
|---|---|---|
| 540,681 | 6/1895 | Myers . |
| 1,177,055 | 3/1916 | Reed . |
| 2,064,826 | 12/1936 | Gabriel . |
| 2,209,778 | 7/1940 | Krasowski . |
| 4,057,210 | 11/1977 | Wellman . |
| 4,181,234 | 1/1980 | Feighan . |
| 4,204,367 | 5/1980 | Cone . |
| 4,646,469 | 3/1987 | Scism ..... 47/67 |

FOREIGN PATENT DOCUMENTS

| | | |
|---|---|---|
| 196167 | 2/1958 | Austria . |
| 27024 | 12/1939 | India . |

*Primary Examiner*—Robert A. Hafer
*Assistant Examiner*—Bradley M. Lewis
*Attorney, Agent, or Firm*—Bell, Seltzer, Park & Gibson

[57] ABSTRACT

A basket used in displaying household plants is provided. The basket is characterized by improved resistance to the deteriorating effects of water exposure and includes a woven shell of interwoven cellulose strips and a molded plastic base fastened to the shell to form the basket. The base includes a water containing reservoir and a spacer to improve the durability of the otherwise cellulose basket.

16 Claims, 1 Drawing Sheet

PLANT BASKET

CROSS-REFERENCE TO RELATED APPLICATION

This application is a continuation of my application Ser. No. 707,241 which was filed on Mar. 1, 1985, entitled PLANT BASKET which has now matured into U.S. Pat. No. 4,646,469.

BACKGROUND OF THE INVENTION

This invention relates to the construction of a basket for displaying household plants. The criteria which basket designers and fabricators strive to satisfy include aesthetic appeal, durability, versatility and convenience. Notwithstanding efforts to meet these demands, no known mode of construction satisfactorily complies with these criteria. For example, while baskets manufactured from plastic may be durable, they very often lack aesthetic appeal. On the other hand, woven baskets constructed from wood or other cellulose material possess a high degree of aesthetic appeal yet they lack durability as a result of the deteriorating effects of repeated exposures to water. It is the latter form of construction to which the present invention is addressed.

A versatile cellulose basket design has not been achieved by the industry. In this regard, baskets have been provided which fall into one of three general categories including those which may be displayed on existing pieces of furniture, suspended from the ceiling or another point of elevation, or which may be free-standing by providing an integral stand. A cellulose basket construction which may be displayed in any of these three fashions has not been achieved previously. Moreover, known hanging basket constructions are unstable since the basket is not physically connected in any manner to the hanging element. That is, the hanging element is generally formed of three strands of cord or rope which are joined at one end to form a loop and knotted together at the other end. The basket is then placed in the element and the three strands of yarn are arranged about the basket. If one strand is displaced, the basket is then free to fall out of the hanging element.

Convenience is an important criterion which has also been neglected in large measure by prior basket designs. In this vein, convenience may be considered synonymous with the ease with which the plants may be watered. The all too familiar problems caused by overwatering have been addressed without success. Baskets woven from cellulose material generally have bottoms made from the same cellulose material as is used to manufacture the shell (e.g., integrally woven with the basket shell) or employ a particle board bottom. In both constructions, these bottoms rapidly deteriorate upon repeated exposure to moisture so that the owner must remove the plant from the basket for watering, allow any excess water to drain therefrom, and then return the potted plant to the basket. This procedure is not only inconvenient, but may also be deleterious to the plant since it will be deprived of excess water which it could later withdraw from the reservoir as needed. Plastic liners have been provided in these baskets with only limited success. While the liners prevent limited amounts of moisture from contacting the cellulose bottoms, they are easily torn or punctured, and either fail to provide the much desired water reservoir or permit the potted plant to sit in a pool of water. Conventional drip trays (e.g. plastic trays) fail to remedy the problem since the pot rests within the tray and therefore occupies a major portion of the available volumetric area available for water retention.

Therefore, it is an object of the present invention to provide a basket construction of predominately woven cellulose material so as to be aesthetically pleasing, while avoiding the shortcomings associated with prior basket designs of this type.

SUMMARY OF THE INVENTION

The basket construction which avoids many of the problems addressed above includes a shell woven from cellulose material and a plastic base to which the shell is affixed. The base is equipped with a water-retaining reservoir so that a plant need not be removed from the basket for watering. In addition, a spacer is provided at or near the center of the reservoir so that the volumetric area available for retaining water is not displaced by the pot when it is positioned inside the basket. Also, integrally formed stake positioning indicia are preferably provided on the rim of the base so that the vertical stakes of the woven basket shell may be attached to the base with a high degree of precision.

BRIEF DESCRIPT10N OF THE DRAWINGS

Additional features of the invention will be described below in detail, when taken in connection with the accompanying drawings, in which FIG. 1 is a perspective view of a basket made in accordance with the invention;

DESCRIPT10N OF THE PREFERRED EMBODIMENT

Figure 1:
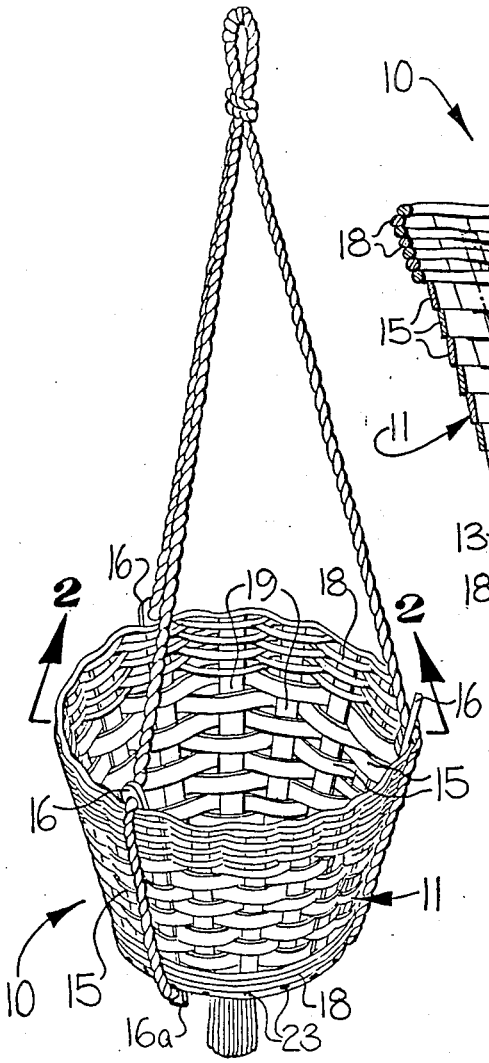

Referring now more specifically to the drawings in which a preferred embodiment of the present invention is shown, a basket 10 incorporating the features of the present invention is illustrated in FIG. 1.

Basket 10 is formed of a woven frusto-conically shaped shell 11 and a base 12. For ease of reference, the term "shell" as used herein should be understood to encompass both a prefabricated bottomless woven basket as well as the materials which together form the body of the basket (i.e., other than the base) where the body is actually fabricated on the base, as is preferred.

Figure 2:
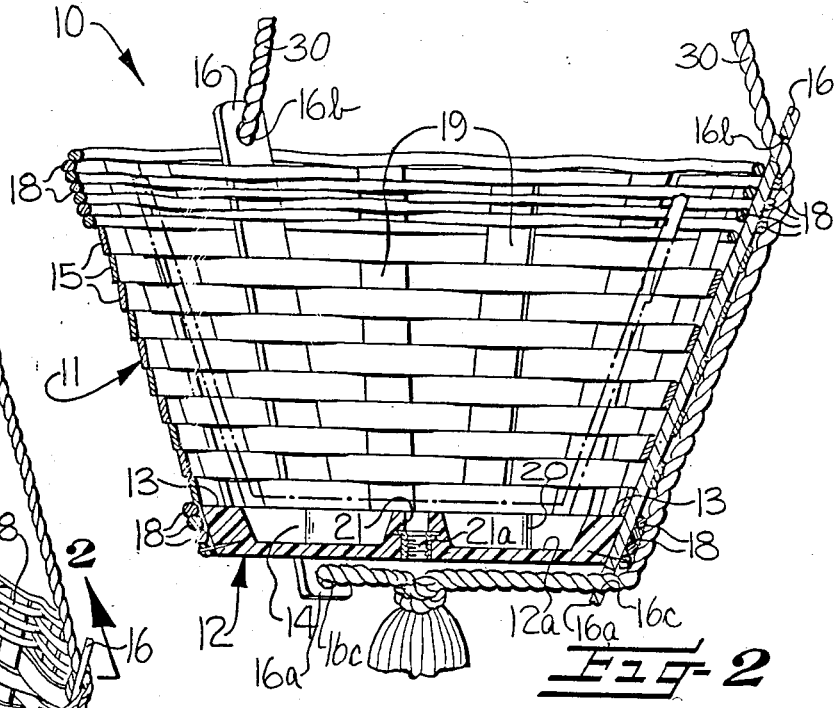
FIG. 2 is a transverse section taken substantially along line 2—2 in FIG. 1.

The basket shell 11 may be woven entirely from cellulose lath strips 15 (FIG. 2). In the alternative, the shell 11 may be formed by weaving the cellulose lath strips 15 around or between wooden stakes 16, 19 (described more fully hereinbelow). The lath strips 15 may be adhesively bound to each other or to the stakes so as to provide a shell of greater dimensional stability. The particular method used in weaving and the particular cellulose lath selected (e.g. willow, cane or other flexible cellulose material) may vary widely depending upon the desired final appearance of the basket. Flexible cellulose cord 18 is preferably used at the border and/or foot of the basket shell 11 to provide an aesthetically pleasing finished basket having the appearance of baskets fabricated entirely from cellulose lath. This is particularly true at the foot of the shell 11 where the cellulose cord 18 may serve to shield the base 12 from view (see FIG. 1). The cellulose cord 18 may be either interwoven or simply wrapped about the shell 11 of the basket.

Figure 3:
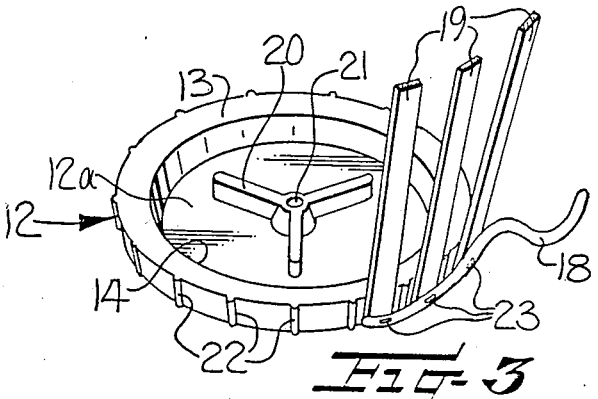
FIG. 3 is a fragmentary perspective view of the base with several stakes attached thereto.
Figure 4:
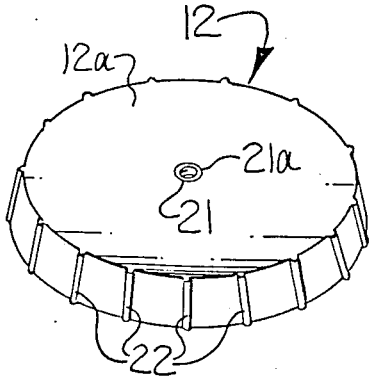
FIG. 4 is a perspective view of the bottom of the base.

The base 12 has a bottom 12*a* with a planar bottom surface, and which bottom is circumscribed by a thickened peripheral portion to form an integral rim 13 so as to form a reservoir 14 (FIG. 3). The rim has an upwardly and outwardly diverging outer periphery. In addition, the base includes a spacer 20 which functions to prevent the displacement of the available volume for water retention in the reservoir by the potted plant. As shown in FIG. 3, the spacer 20 is preferably formed of a plurality of arms radially extending from the center of the base and terminating in spaced relation to said rim and collectively being "Y"-shaped so that the pot supported thereon will be balanced while at the same time the area occupied by the spacer is relatively small, again to maximize the volume in the reservoir available for water retention. The spacer 20 may assume a variety of configurations and need not be positioned in the center of the reservoir. For example a plurality of ribs radiating from the rim toward the center may adequately provide the desired end.

Figure 5:
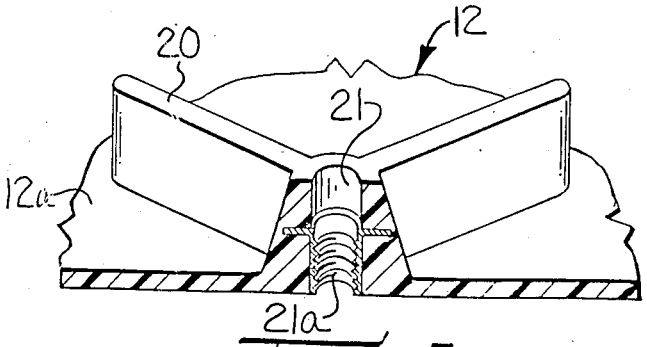
FIG. 5 is a fragmentary perspective view of the base in partial cross section.

Preferably, an internally threaded elongate aperture 21 is provided in the center of base 12 and spacer 20. Aperture 21 permits basket 10 to be used together with a conventional tripod leg assembly to form a free-standing planter. Aperture 21 preferably is formed by an internally threaded metal insert 21*a* (FIG. 5) which may be integrally molded into the plastic base.

The base 12 is preferably provided with stake positioning ribs or indicia 22 which are molded on the rim 13 (FIG. 3) and which are preferably arranged in a circular array around the periphery of the base 12. As shown, the ribs 22 are elongate and uniformly spaced apart on the rim 13 and oriented to extend upwardly from the bottom of the base and serving as stake positioning indicia along the periphery of the rim. The indicia 22 allow for very precise fabrication of the basket particularly where the shell is to be formed on the base. As shown in FIG. 3, each of the vertical weaving stakes 19 (as well as the suspending stakes 16—FIG. 2) may be positioned in a circular array by reference to the indicia 22 and attached by any suitable fastener means including staples 23. Also, as shown in FIG. 3, cellulose cord 18 is preferably wound about the periphery of the base 12 at the foot of the basket and attached with staples or other means. Thereafter, a plurality of cellulose lath strips 15 (FIG. 2) may be interwoven around or between the stakes 16, 19 to form the woven pattern in the finished basket.

The stakes may be of one or more types including basket suspending stakes 16 which are three in number and positioned about 120° apart from each other (FIG. 2) and weaving stakes 19 (FIG. 3). The suspending stakes 16 are best shown in FIG. 2 and are characterized by being longer than weaving stakes 19. As shown, the suspending stakes preferably have upper and lower portions which extend beyond the upper and lower portions of said weaving stakes. The lower ends of said suspending stakes 16 are substantially coplanar so as to serve as supporting feet 16*a* in the event the basket is not supported from above. Upper and lower portions of each of the suspending stakes 16 have respective upper and lower apertures 16*b*, 16*c* provided therein for receiving flexible suspending members 30 shown in the form of cords for suspending the basket (when used as a hanging basket—see FIG. 1). The cords are threaded through these apertures 16*b*, 16*c* and are joined in a decorative knot at their lower terminal ends (FIG. 2). As shown, the suspending members have portions which extend through each of the lower apertures 16*c* and then extend upwardly along the outer portion of the basket and inwardly through the upper apertures 16*b*, with the respective upper ends of the suspending members being gathered together a predetermined distance above the basket so as to facilitate the placement of a plant within the basket and the ready removal thereof. In this manner, the basket cannot be accidentally dislodged as a result of displacing one of the cords.

The potted plant may be inserted directly in the basket 10. Alternatively, the potted plant together with a conventional plastic drip tray may be placed in the basket. The choice will depend upon the placement of the drainage holes in the bottom of the pot and the configuration of the spacer 20. If the pot is of the type having a single drainage hole in the center of the pot, the conventional drip tray may be desired where the preferred spacer configuration is used. In this manner, the reservoir will collect the overflow from the drip tray, but the plant may retrieve water from the tray as needed. If the spacer 20 has a different configuration, however, the central opening in the pot may not be blocked by the hub of the spacer so that the drip tray may be eliminated. Where the pot has a plurality of openings about its periphery, use of the drip tray may be eliminated or may be retained as desired. In this connection, the vertical height of the spacer 20 may be slightly less than the height of the rim 13 of the base 12 (FIG. 3) so as to allow the plant to sit at a lower elevation and within the reservoir so as to withdraw water from the reservoir when no drip tray is used.

The finished preferred basket may be used on existing display stands, suspended from an elevated point, or joined with a conventional leg assembly to form a free-standing receptacle. Except where it is used as a free-standing planter, a threaded plug (not shown) may be employed in the threaded aperture 21 to prevent water loss from the potted plant (i.e., directly through the aperture as where the pot has a single, central opening in the bottom).

That which is claimed is:

1. A basket for displaying household plants comprising a circular base of molded plastic material having a bottom with a substantially planar bottom surface and a thickened peripheral portion serving as a rim and extending upwardly from said bottom so as to form with said bottom a water retaining reservoir, a spacer connected to said bottom and disposed within the reservoir and comprising a plurality of arms having upper surfaces adapted to supportingly receive a flower pot positioned within the basket, said rim having an upwardly and outwardly diverging outer periphery, a plurality of uniformly spaced apart positioning means integrally formed with and extending around said rim in a circular array and serving as stake positioning indicia along the periphery of said rim, a frusto-conically shaped shell of interwoven material surrounding said plastic base and extending upwardly therefrom, said interwoven material including a circular array of a plurality of uprightly positioned stakes uniformly spaced about said rim of said base and each stake being located between adjacent pairs of said spaced apart means, and fastener means penetrating each of said stakes adjacent lower portions thereof and securing the stakes to said rim of said plastic base.

2. A basket for displaying household plants comprising a circular base of molded plastic material having a bottom with a substantially planar bottom surface and a thickened peripheral portion serving as a rim and extending upwardly from said bottom so as to form with said bottom a water retaining reservoir, a spacer integrally molded with said bottom and disposed within the reservoir and comprising a plurality of arms having upper surfaces adapted to supportingly receive a flower pot positioned within the basket, said rim having an upwardly and outwardly diverging outer periphery, a plurality of spaced apart elongate ribs integrally formed with said rim and extending outwardly from said rim, said ribs being uniformly spaced apart in a circular array and oriented to extend upwardly from the bottom of said base and serving as stake positioning indicia along the periphery of said rim, a frusto-conically shaped shell of interwoven material surrounding said plastic base and extending upwardly therefrom, said interwoven material including a circular array of a plurality of uprightly positioned stakes uniformly spaced about said rim of said base and each stake being located between pairs of said ribs, and fastener means penetrating each of said stakes adjacent lower portions thereof and securing the stakes to said rim of said plastic base.

3. A basket according to claim 1 or 2 wherein upper surfaces of said arms are positioned at a lower elevation than the upper surface of said rim so as to allow a flower pot when positioned in the basket to sit at a lower elevation and within the reservoir so as to readily withdraw water from the reservoir.

4. A basket according to claim 1 or 2 including means centrally disposed in said base for securing the basket to a supporting stand to adapt the basket for use as a free-standing basket.

5. A basket according to claim 4 wherein said means in said base to secure the basket to a supporting stand comprises a threaded metal insert open to the bottom of the base.

6. A basket according to claim 1 or 2 wherein three of said plurality of stakes are longer than the remaining stakes and are uniformly spaced apart from each other, each of said longer stakes having upper and lower ends extending beyond the ends of the remaining stakes with the lower ends of said longer stakes serving as supporting feet in the event the basket is not otherwise supported.

7. A basket according to claim 1 or 2 wherein said plurality of arms of said spacer extend radially from the center of said base and terminate in spaced relation to said rim.

8. A basket according to claim 7 including means disposed in said base to secure the basket to a supporting stand and comprising an internally threaded metal insert centrally disposed in the base and open to the bottom of the base, and wherein upper portions of said threaded metal insert extend within central regions of said spacer.

9. A basket for displaying household plants comprising a circular base of molded plastic material having a bottom with a substantially planar bottom surface and a thickened peripheral portion serving as a rim and extending upwardly from said bottom so as to form with said bottom a water retaining reservoir, a spacer integrally molded with said bottom and disposed within the reservoir and comprising a plurality of arms having upper surfaces adapted to supportingly receive a flower pot positioned within the basket, upper surfaces of said arms being positioned at a lower elevation than the upper surface of said rim so as to allow a flower pot when positioned in the basket to sit at a lower elevation and within the reservoir so as to readily withdraw water from the reservoir, said plurality of arms extending radially from the center of said base and terminating in spaced relation to said rim, said rim having an upwardly and outwardly diverging outer periphery, a plurality of spaced apart elongate ribs integrally formed with said rim and extending outwardly from said rim in a circular array, said ribs being uniformly spaced apart and oriented to extend upwardly from the bottom of said base and serving as stake positioning indicia along the periphery of said rim, a frusto-conically shaped shell of interwoven material surrounding said plastic base and extending upwardly therefrom, said interwoven material including a circular array of a plurality of uprightly positioned stakes uniformly spaced about said rim of said base and each stake being located between pairs of said ribs, and fastener means penetrating each of said stakes adjacent lower portions thereof and securing the stakes to said rim of said plastic base.

10. A basket according to claim 9 wherein three of said plurality of stakes are longer than the remaining stakes and are uniformly spaced apart from each other, each of said longer stakes having upper and lower ends extending beyond the ends of the remaining stakes with the lower ends of said longer stakes serving as supporting feet in the event the basket is not otherwise supported.

11. A circular base of molded plastic material constructed for use as a bottom for a basket for displaying live household plants, said base having a bottom with a substantially planar bottom surface and a thickened peripheral portion serving as a rim and extending upwardly from said bottom so as to form with said bottom a water retaining reservoir, a spacer connected to said bottom and disposed within the reservoir and comprising a plurality of arms having upper surfaces adapted to supportingly receive a flower pot, said rim having an upwardly and outwardly diverging outer periphery adapted to accommodate a circular array of basket forming stakes thereon, a circular array of a plurality of uniformly spaced apart positioning means integrally formed with and extending around said rim and adapted to serve as positioning indicia for the basket forming stakes along the periphery of said rim.

12. A circular base of molded plastic material constructed for use as a bottom for a basket for displaying live household plants, said base having a bottom with a substantially planar bottom surface and a thickened peripheral portion serving as a rim and extending upwardly from said bottom so as to form with said bottom a water retaining reservoir, a spacer integrally molded with said bottom and disposed within the reservoir and comprising a plurality of arms having upper surfaces adapted to supportingly receive a flower pot, said rim having an upwardly and outwardly diverging outer periphery adapted to accommodate a circular array of basket forming stakes thereon, a circular array of a plurality of spaced apart elongate ribs integrally formed with said rim and extending outwardly from said rim, said ribs being uniformly spaced apart and oriented to extend upwardly from the bottom of said base and adapted to serve as positioning indicia for the basket forming stakes along the periphery of said rim.

13. A circular base according to claim 11 or 12 including means disposed in said base to secure a basket incorporating the base to a supporting stand comprising an elongate aperture extending through the center of said base.

14. A circular base according to claim 13 wherein said means in said base to secure a basket incorporating the base to a supporting stand comprises a threaded metal insert open to the bottom of the base.

15. A circular base according to claim 11 or 12 wherein said plurality of arms of said spacer extend radially from the center of said base and terminate in spaced relation to said rim.

16. A circular base according to claim 15 including means in said base to secure a basket incorporating the base to a supporting stand and comprising an internally threaded metal insert centrally disposed in the base and open to the bottom of the base, and wherein upper portions of said threaded metal insert extend within central regions of said molded spacer.

* * * * *